US006848759B2

(12) United States Patent
Doornbos et al.

(10) Patent No.: US 6,848,759 B2
(45) Date of Patent: Feb. 1, 2005

(54) SELF-CLOSING SLIDE MECHANISM WITH DAMPING

(75) Inventors: David A. Doornbos, Manteno, IL (US); Steven L. Bivens, Kankakee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 79 days.

(21) Appl. No.: 10/350,814

(22) Filed: Jan. 24, 2003

(65) Prior Publication Data

US 2003/0189395 A1 Oct. 9, 2003

Related U.S. Application Data

(60) Provisional application No. 60/369,508, filed on Apr. 30, 2002.

(51) Int. Cl.[7] ..... A47B 88/00

(52) U.S. Cl. ..... 312/319.1; 312/333; 16/64; 188/82.1

(58) Field of Search ..... 312/319.1, 330.1, 312/331, 333, 334.1, 334.7, 334.8, 334.16; 16/64; 188/82.1

(56) References Cited

U.S. PATENT DOCUMENTS

| | | | | | |
|---|---|---|---|---|---|
| 4,494,806 | A | * | 1/1985 | Williams et al. | 312/333 |
| 4,828,344 | A | * | 5/1989 | Omata | 312/319.1 |
| 4,872,239 | A | * | 10/1989 | Ferguson et al. | 16/64 |
| 5,207,781 | A | * | 5/1993 | Rock | 312/319.1 |
| 5,474,375 | A | * | 12/1995 | Hollenstein et al. | 312/319.1 |
| 6,473,936 | B2 | * | 11/2002 | Orita | 16/82 |
| 6,499,818 | B2 | * | 12/2002 | Brustle | 312/319.1 |
| 6,629,738 | B2 | * | 10/2003 | Salice | 312/333 |
| 6,666,306 | B2 | * | 12/2003 | Gasser | 188/82.1 |
| 2001/0008037 | A1 | | 7/2001 | Brustle | 16/71 |
| 2001/0008358 | A1 | | 7/2001 | Brustle | 312/319.1 |
| 2002/0096405 | A1 | | 7/2002 | Grasser | 188/82.1 |

FOREIGN PATENT DOCUMENTS

| | | |
|---|---|---|
| DE | 199 09 734 A 1 | 9/2000 |
| DE | 200 06 068 U 1 | 9/2000 |
| WO | WO 01/50916 | 7/2001 |

* cited by examiner

*Primary Examiner*—Peter R. Brown
(74) *Attorney, Agent, or Firm*—Mark W. Croll; Paul F. Donovan

(57) ABSTRACT

A self-closing slide is movable between an open position and a closed position. The slide includes a frame, a linear gear on the frame and a carriage configured for movement along the frame. A biasing element operably connects the frame and the carriage to bias the carriage to the closed position. A pinion gear is carried by the carriage and is positioned for movement along the linear gear with movement of the carriage along the frame. A damper is operably connected to the pinion gear and to the carriage and an engagement gear is operably mounted to the carriage and to the damper. The engagement gear is movable between a first, engaged position in which the engagement gear engages the damper and a second, disengaged position in which the engagement gear disengages the damper. When the carriage is moved from the closed position toward the open position, the engagement gear is in the second, disengaged position to disengage the damper so that the pinion gear rotates. When the carriage is moved from the open position toward the closed position, the engagement gear is in the first, engaged position to engage the damper, damping rotation of the pinion gear along the linear gear.

16 Claims, 1 Drawing Sheet

SELF-CLOSING SLIDE MECHANISM WITH DAMPING

CROSS-REFERENCE TO RELATED APPLICATION DATA

The present application claims priority of U.S. Provisional Application Ser. No. 60/369,508, filed Apr. 3, 2002.

BACKGROUND OF THE INVENTION

The present invention relates to sliding-type closure mechanisms. More particularly, the present invention relates to self-closing sliding closure mechanisms having dampers for controlling the movement in at least one direction for use on sliding devices such as kitchen drawers, sliding racks, desk drawers, cabinets, and the like.

Assisted closure mechanisms are used in a wide variety of applications. For example, it may be desirable to use an assisted closure for moving a mechanism in one direction, typically in the closing direction. Such assisted closure may be highly desirable in drawers, such as desk drawers and the like. Typically, such closure mechanisms utilize spring assists.

With spring assists, the mechanism can be made self-closing, requiring only an initial start to unseat it from a secured, opened position. Such spring or other assists facilitate reducing the effort required to, for example, close the drawer and to assure that the drawer completely closes.

However, it has been found that an assist of sufficient strength to automatically and fully close a heavily loaded drawer or the like can result in abrupt movements and rapid closing. At times, the "strength" of the assist results in a significant impact upon reaching the fully closed position.

As such, it has been found to be advantageous to temper, or damp the action of the spring, so that the drawer or the like closes more gently. It may also be desirable to deactivate or circumvent the damping mechanism in the opposite direction, that is, when the drawer is being pulled open. In that the opposite (e.g., opening) motion may be done without mechanical assist, and in fact may itself be restrained by the expansion of an extension spring used to assist closing, further damping is not needed and may be undesirable.

In addition, due to the varying nature of these devices, it is not known to incorporate a spring assist device in a single, unitary device with a damping arrangement. In fact, when used in conjunction with one another, known configurations typically employ a spring return on one side of, for example a drawer (at one runner or slide), and a damping mechanism at the other side (along the other runner or slide) of the drawer.

Accordingly, there exists a need for a self-closing slide mechanism that has a damper operational in the closing direction. Desirably, such a self-closing slide mechanism is not operational in the opening direction of a drawer or the like to which the self-closing slide is connected.

BRIEF SUMMARY OF THE INVENTION

A self-closing mechanism or slide is movable between an open position and a closed position. The mechanism or slide has a damper that is engaged or operational in the closing direction and disengaged or non-operational in the opening direction.

The slide includes a frame, a linear gear on the frame and a carriage configured for movement along the frame. A biasing element, such as a return spring operably connects the frame and the carriage. The spring biases the frame to the closed position.

A pinion gear is carried by the carriage and is positioned for movement along the linear gear with movement of the carriage along the frame. A damper is operably connected to the pinion gear and to the carriage. The damper selectively dampens movement or rotation of the pinion gear.

An engagement gear is operably mounted to the carriage and is operably connected to the damper. The engagement gear is movable between a first, engaged position in which the engagement gear engages the damper and a second, disengaged position in which the engagement gear disengages the damper.

When the carriage is moved from the closed position toward the open position, the engagement gear is in the second, disengaged position. In this position, the damper is disengaged so that the pinion gear rotates, moving along with the linear gear in an undampened state. Conversely, when the carriage is moved from the open position toward the closed position, the engagement gear is in the first, engaged position. In this position, the engagement gear engages the damper, damping rotation of the pinion gear along the linear gear.

In a preferred embodiment, the engagement gear is mounted to the carriage to move within the carriage between the first, engaged position and the second, disengaged position. In such an embodiment, the carriage can include a carriage projection so that the engagement gear engages the carriage projection when in the first, engaged position and so that the engagement gear is disengaged from the carriage projection when in the second, disengaged position.

To facilitate locking and unlocking the engagement gear, the carriage includes an elongated slot, and a shaft operably connects the engagement gear and the damper, extending through the elongated slot. The engagement gear/damper assembly moves within the elongated slot and for moving the engagement gear between the first, engaged position and the second, disengaged position.

In a present embodiment, the frame includes a plurality of slots and the carriage includes a guide portion for receipt in one or more of the slots for moving the carriage along the frame. The slots and guide assure that the carriage remains properly mounted to and aligned within the frame. On or more of the slots can include a detent in an end thereof for locking the carriage at the detent.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
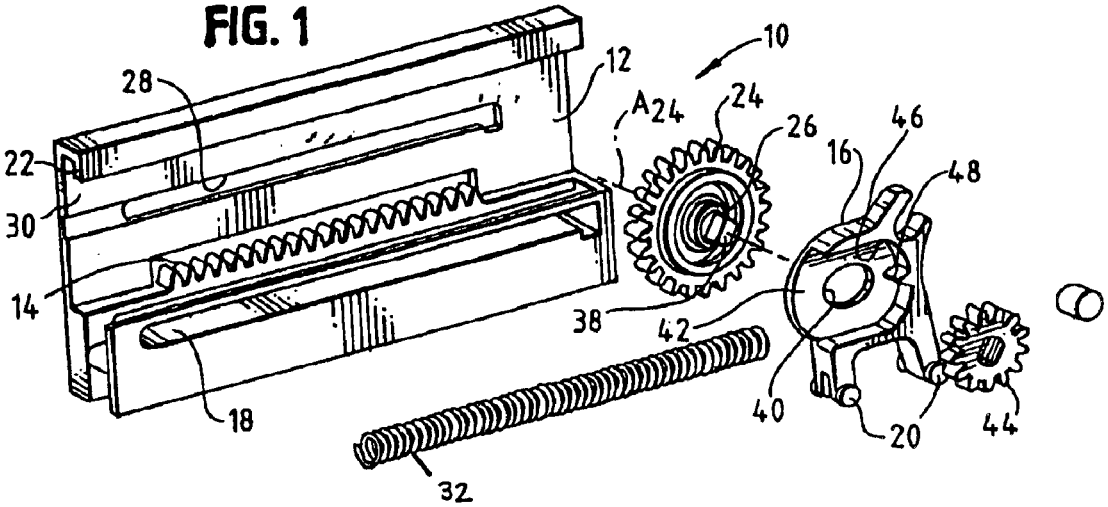
FIG. 1 is an exploded view of a self-closing slide mechanism embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description of the Invention", relates to a requirement of the United States Patent Office, and does not imply, nor should be inferred to limit the subject matter disclosed herein.

Referring now to the figures and in particular, to FIG. 1, there is shown a self-closing slide mechanism 10 embodying the principles of the present invention. The present slide mechanism 10 captures an integral damper in a carrier mechanism such that the damper is engaged and operational when the drawer or the like is moved in one direction, such as pushed closed, but is disengaged and non-operational when the drawer is moved toward the other direction, such as toward an open position.

The self-closing slide 10 includes a frame 12 having a linear rack gear 14 thereon. As illustrated, the rack gear 14 can be formed integral with the frame 12. Alternately, although not shown, the rack gear can be mounted to the frame. A carriage 16 is movable adjacent the rack gear 14. In a preferred arrangement, the carriage 16 is mounted to the frame 12 for sliding engagement with the frame 12. More preferred, the carriage 16 is secured to the frame 12 for sliding therealong. In an exemplary slide 10, the frame 12 includes slots 18 formed therein that enclose guide or feet portions 20 of the carriage 16. In such an arrangement, the carriage 16 is prevented from inadvertently dislodging from, or jamming in, the frame 12. In the exemplary slide 10, the slots 18 are formed in a lower portion side portion of the frame 12. The frame 12 can also include a depending lip 22 that extends downwardly, toward the rack gear 14.

A pinion gear 24 is mounted to the carriage 16, and is positioned to traverse back and forth along the frame 12, engaging or meshing with the rack gear 14. The pinion gear 24 is mounted to a damper 26 that is positioned on the rotational axis $A_{24}$ of the pinion gear 24. That is, the pinion gear 24 rotates about the damper 26. Alternatively, the pinion gear 24 can be molded as part of the damper housing. The damper 26, as will be discussed below, when engaged, dampens or provides resistance to movement of the pinion gear 24 along the rack gear 14 by resisting rotation of the pinion gear 24, similar to a braking function. For purposes of securing the carriage 16 (and pinion gear 24) to the frame 12, a pin or shaft portion (not shown) can extend through an opening 28 in a rear wall 30 of the frame 12. In addition, the pinion gear 24 can be captured between the rack gear 14 and the frame lip 22 to facilitate securing the gear 24 to the frame 12.

Figure 2:
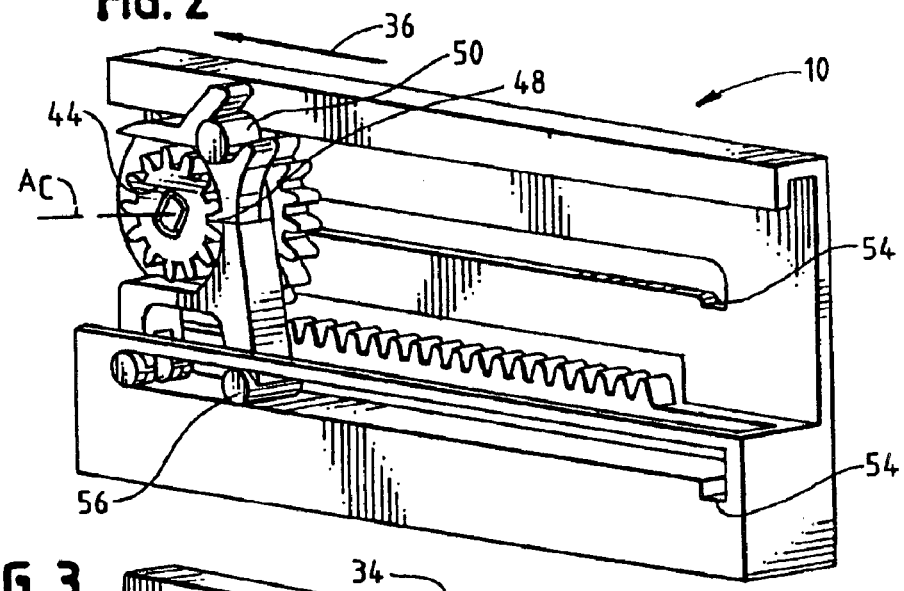
FIG. 2 is a perspective view of the slide mechanism shown in the closed or relaxed state with the damper in the engaged condition.

An extension spring 32 is attached at one end to the carriage 16 and at another end to the frame 12. The force exerted by the spring 32 pulls the carriage 16 toward the closed position (FIG. 2). This provides the closing assist, or self-closing feature of the slide 10.

Figure 3:
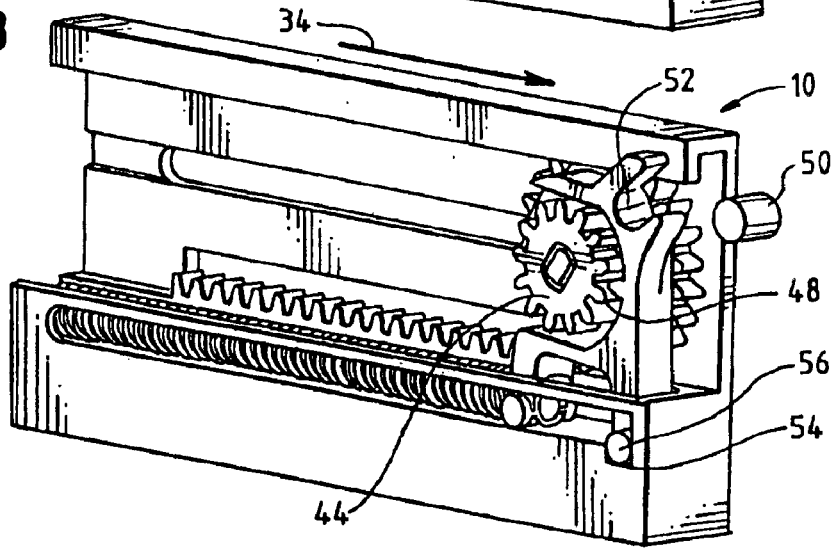
FIG. 3 is a perspective view of the slide mechanism shown in the open or tensioned state with the damper in the disengaged condition.

The damper 26, to which the pinion gear 24 is mounted, is operably connected to the carriage 16 such that it rotates freely with the pinion gear 24 in one direction (moving from the closed position to the open position as indicated by the directional arrow 34 in FIG. 3), but is restrained from rotation in an opposite direction (moving from the open position to the closed position as indicated by the directional arrow 36 in FIG. 2). In this configuration, the damper 26 is non-operational or non-functional when the drawer (or the like) is pulled out to the open position, but provides a damping effect when the drawer is returned to the closed position.

In a present embodiment, this one-way damping action is provided by a moving gear mounting assembly. Referring to FIG. 1, the damper 26 includes a keyed shaft 38 that extends through an elongated slot 40 in a wall 42 of the carriage 16. An engagement gear 44 (keyed for mating engagement with the damper shaft 38) is connected to the damper shaft 38, on the opposite side of the carriage wall 42 from the pinion gear 24. In such an arrangement, the engagement gear 24 and pinion gear 44 are thus secured to the carriage wall 42. In that the slot 40 is elongated, a common rotational axis $A_c$ of the pinion gear 24/damper 26/engagement gear 44, as an assembly, moves relative to its mounting in the carriage 16.

A recess 46 is formed in the wall 42 of the carriage 16 (on that side of the carriage 16 onto which the engagement gear 44 is fitted). The recess 46 essentially provides a captive region for the engagement gear 44. It is within this captive region 46 that the engagement gear 44 moves to effect the one-way damping action. To this end, at least one tooth or cog 48 extends into the captive region 46 that is configured to engage the engagement gear 44. In that the engagement gear 44 moves along the slotted opening 40 in the carriage wall 42, the engagement gear 44 moves into and out of engagement with the tooth 48. When the engagement gear 44 is engaged with the tooth 48, as illustrated in FIG. 2, the damper 26 is engaged which provides damping effect on rotation of the pinion gear 24.

Conversely, when the pinion gear 24/damper 26/engagement gear 44 assembly shifts away from the tooth 48 (as illustrated in FIG. 3), the engagement gear 44 is disengaged from the tooth 48. This disengages the damper 26 and allows the assembly to rotate freely in the slot 40. Thus, there is no damping action on rotation of the pinion gear 24.

In an exemplary application, the self-closing slide mechanism 10 is attached to a drawer slide. A pin or the like (such as the exemplary pin 50) can be fitted into a retainer 52 in the carriage and can be used to selectively engage the carriage 16 with the drawer runner slide (not shown). Detents 54 can be formed in the frame slots 18 into which the carriage feet 20 are positioned. In addition, capture pins, extensions or the like 56, can engage the frame slot detents 54 to hold the carriage 16 in the open position.

In operation, from an open position, as a drawer or the like is pushed closed, the pin 50 on the drawer runner slide engages the carriage 16. The momentum of the closing drawer forces the capture pin 56 from the carriage slot detent 54, thus unlocking the carriage 16 from the detents 54 in the slot 18. Once unlocked, the extension spring 32 pulls the carriage 16 toward the closed position. As the carriage 16 is pulled toward the closed position, the pinion gear 24/damper 26/engagement gear 44 assembly slides in the slot 40 in the carriage wall 42, toward the tooth 48 in the captive region 46. This engages the engagement gear 44 (and thus the damper 26) to dampen rotation of the pinion gear 24 and thus movement along the frame rack gear 14.

When the drawer is pulled toward the open position from a closed position, the carriage 16 moves within the slotted opening 40 causing the engagement gear 44 to disengage from the tooth 48 on the carriage 16 (in the captive region 46). In this position, the damper 26 is free to rotate in the slot 40 with the pinion gear 24, without resistance. As such, there is no damping of the rotation of the pinion gear 24. This provides for freely opening the drawer without damping effect. Incorporating the slot detents 54 and capture pins 56 permits configuring the slide 10 so that the carriage 16 rotates slightly at the end of the opening stroke to lock the carriage 16 to the frame 12. In this manner, the carriage 16 remains locked until the drawer is urged (slightly) to the closed position, which unlocks the capture pins 56 from the detents 54.

Although one-way damping has been achieved with other devices, typically additional gears are required with multiple assemblies. Commonly, a damper assembly is attached to one of the drawer slides or runner, and a separate spring-loaded mechanism is assembled to the mating rail.

The present self-closing slide 10, on the other hand, provides an integral, compact and efficient unit in which a number of advantageous and desirable characteristics are afforded all in a relatively cost effective design. Moreover, because of the integral design, such a slide 10 substantially simplifies the structure required for one-way damping of a self-closing slide mechanism.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A self-closing slide movable between an open position and a closed position, comprising:

a frame;

a linear gear on the frame;

a carriage configured for movement along the frame;

a biasing element operably connecting the frame and the carriage to bias the carriage to the closed position;

a pinion gear carried by the carriage and positioned for movement along the linear gear with movement of the carriage along the frame;

a damper operably connected to the pinion gear and to the carriage; and an engagement gear operably mounted to the carriage and operably connected to the damper, the engagement gear movable between a first, engaged position in which the engagement gear engages the damper and a second, disengaged position in which the engagement gear disengages the damper, wherein when the carriage is moved from the closed position toward the open position, the engagement gear is in the second, disengaged position to disengage the damper so that the pinion gear rotates, moving along the linear gear in an undampened state, and wherein when the carriage is moved from the open position toward the closed position, the engagement gear is in the first, engaged position to engage the damper, damping rotation of the pinion gear along the linear gear.

2. The self-closing slide in accordance with claim 1 wherein the engagement gear is mounted to the carriage so as to move within the carriage between the first, engaged position and the second, disengaged position.

3. The self-closing slide in accordance with claim 2 wherein the carriage includes a carriage projection and wherein the engagement gear engages the carriage projection when in the first, engaged position and wherein the engagement gear is disengaged from the carriage projection when in the second, disengaged position.

4. The self-closing slide in accordance with claim 1 wherein the carriage includes an elongated slot, and wherein a shaft operably connects the engagement gear and the damper, the shaft extending through the elongated slot for moving therein and for moving the engagement gear between the first, engaged position and the second, disengaged position.

5. The self-closing slide in accordance with claim 1 wherein the frame includes a slot therein and wherein the carriage includes a guide portion for receipt in the slot for moving the carriage along the frame.

6. The self-closing slide in accordance with claim 5 wherein the slot includes a detent in an end thereof for locking the carriage at the detent.

7. A self-closing slide movable between an open position and a closed position, comprising:

a frame;

a frame gear on the frame;

a carriage configured for movement along the frame;

a carriage gear carried by the carriage and positioned for movement along the frame gear;

a damper operably connected to the carriage gear and to the carriage; and a moveable engaging element operably mounted to the carriage and to the damper, the engaging element movable between a first, engaged position in which the damper is engaged and a second, disengaged position in which the damper is disengaged, wherein when the carriage is moved from the closed position toward the open position, the engaging element is in the second, disengaged position and the carriage gear freely rotates on the frame gear, and wherein when the slide is moved from the open position toward the closed position, the engaging element is in the first, engaged position to dampen rotation of the carriage gear.

8. The self-closing slide in accordance with claim 7 including a track on the frame and a mating guide on the carriage for guiding the carriage along the frame, the track having a detent at an end thereof for locking the carriage at the end of the track.

9. The self-closing slide in accordance with claim 8 wherein the slide includes a spring operably connecting the carriage to the frame for urging the frame to the closed position, and wherein the carriage guide locking into the detent prevents the slide from moving toward the closed position.

10. The self-closing slide in accordance with claim 7 including a projection extending from the carriage for engaging the engaging element when the engaging element is in the engaged position.

11. A self-closing slide movable between an open position and a closed position, the slide being dampened in movement from the open position to the closed position and undampened in movement from the closed position to the open position, comprising:

a frame having a linear gear thereon;

a pinion gear/damper assembly including a damper, moveable along the frame, the damper being engaged when the slide is moved from the open position to the closed position and disengaged when the slide is moved from the closed position to the open position;

a biasing element for biasing the pinion gear damper assembly to the closed position; and a moveable engaging element for selectively engaging the damper when the slide is moved from the open position to the closed position and for disengaging the damper when the slide is moved from the closed position to the open position.

12. The self-closing slide in accordance with claim 11 including a carriage configured for movement along the frame, wherein the pinion gear/damper assembly is carried by the carriage.

13. The self-closing slide in accordance with claim 12 wherein the pinion gear/damper assembly includes a shaft extending therefrom providing an axis of rotation for the assembly.

14. A self-closing slide moveable between an open position and a closed position, the slide being dampened in movement from the open position to the closed position and undampened in movement from the closed position to the open position, comprising:

a frame having a linear gear thereon;

a pinion gear/damper assembly including a damper, moveable along the frame, the damper being engaged when the slide is moved from the open position to the closed position and disengaged when the slide is moved from the closed position to the open position, wherein the pinion gear/damper assembly includes a shaft extending therefrom providing an axis of rotation for the assembly;

a carriage configured for movement along the frame, wherein the pinion gear/damper assembly is carried by the carriage;

a biasing element for biasing the pinion gear damper assembly to the closed position; and a moveable engaging element for selectively engaging the damper when the slide is moved from the open position to the closed position and for disengaging the damper when the slide is moved from the closed position to the open position, wherein the engaging element includes an engagement gear carried by the carriage and operably mounted to the pinion gear/damper assembly shaft.

15. The self-closing slide in accordance with claim 14 wherein the carriage includes a captive region for receiving the engagement gear.

16. The self-closing slide in accordance with claim 15 wherein the carriage includes a finger extending into the captive region and wherein the pinion gear/damper shaft extends through an elongated opening in the carriage and is rotational in and moveable within the elongated opening, movement of the pinion gear/damper assembly within the opening effectuating engagement and disengagement of the engagement gear with the finger.

* * * * *